US007552706B2

(12) United States Patent
Krueger

(10) Patent No.: US 7,552,706 B2
(45) Date of Patent: Jun. 30, 2009

(54) AUTOMATIC DECOMPRESSION MECHANISM FOR AN ENGINE

(75) Inventor: Erik P. Krueger, Medina, OH (US)

(73) Assignee: MTD Products Inc, Valley City, OH (US)

( * ) Notice: Subject to any disclaimer, the term of this patent is extended or adjusted under 35 U.S.C. 154(b) by 94 days.

(21) Appl. No.: 11/887,709

(22) PCT Filed: Mar. 28, 2006

(86) PCT No.: PCT/US2006/011223

§ 371 (c)(1),
(2), (4) Date: Oct. 2, 2007

(87) PCT Pub. No.: WO2006/110317

PCT Pub. Date: Oct. 19, 2006

(65) Prior Publication Data

US 2009/0064958 A1 Mar. 12, 2009

Related U.S. Application Data

(60) Provisional application No. 60/669,654, filed on Apr. 8, 2005.

(51) Int. Cl.
*F01L 13/08* (2006.01)

(52) U.S. Cl. ..... 123/182.1

(58) Field of Classification Search ..... 123/90.32, 123/90.57, 90.62, 182.1
See application file for complete search history.

(56) References Cited

U.S. PATENT DOCUMENTS 3,981,289 A * 9/1976 Harkness ..... 123/182.1
4,610,227 A 9/1986 Nakano et al.
4,672,930 A * 6/1987 Sumi ..... 123/182.1
4,696,266 A * 9/1987 Harada ..... 123/182.1
5,197,422 A * 3/1993 Oleksy et al. ..... 123/182.1
5,738,062 A 4/1998 Everts
5,943,992 A * 8/1999 Kojima et al. ..... 123/182.1
6,055,952 A * 5/2000 Gau ..... 123/182.1
6,109,230 A 8/2000 Watanabe et al.
6,343,582 B1 * 2/2002 Peng ..... 123/182.1
6,394,054 B1 * 5/2002 Rado et al. ..... 123/182.1
6,401,678 B1 6/2002 Billetdeaux
6,439,187 B1 * 8/2002 Dietz et al. ..... 123/182.1

(Continued)

FOREIGN PATENT DOCUMENTS

JP 63302116 12/1988

*Primary Examiner*—Stephen K Cronin
*Assistant Examiner*—David Hamaoui
(74) *Attorney, Agent, or Firm*—Wegman, Hessler & Vanderburg

(57) ABSTRACT

An automatic decompression mechanism for selectively actuating a cylinder valve of an engine so as to reduce the starting force required to start the engine. The mechanism includes a cam gear, a centrifugal member, and a cover member comprising an integrally formed biasing means for biasing and retaining the centrifugal member in the cam gear. The biasing means urges the centrifugal member into a decompression position when the cam gear is rotating at a lower speed, wherein a projecting portion of the centrifugal member actuates the valve mechanism to reduce the starting force required to start the engine. During normal engine operation, the centrifugal member pivots into a non-decompression position wherein the projecting portion of the centrifugal member recedes below the cam profile surface so as to prevent the projecting portion from actuating the valve mechanism.

16 Claims, 8 Drawing Sheets

U.S. PATENT DOCUMENTS 6,659,057 B2 12/2003 Billetdeaux
6,672,269 B1 * 1/2004 Bonde et al. ..... 123/182.1
6,782,861 B2 8/2004 Gracyalny et al.
6,848,407 B2 2/2005 Kobayashi et al.
2004/0261744 A1 * 12/2004 Tsutsumi et al. ..... 123/182.1
2005/0109304 A1 * 5/2005 Rotter et al. ..... 123/182.1
2006/0272607 A1 * 12/2006 Grybush ..... 123/182.1

* cited by examiner

AUTOMATIC DECOMPRESSION MECHANISM FOR AN ENGINE

CROSS-REFERENCE TO RELATED APPLICATION

The present application claims priority under 35 U.S.C. §119(e) to U.S. Provisional Patent Application No. 60/669,654, filed Apr. 8, 2005.

BACKGROUND OF THE INVENTION

1. Field of Invention

The present invention relates to a decompression mechanism for an engine, and more particularly relates to an automatic decompression mechanism for an internal combustion engine. The automatic decompression mechanism selectively actuates a cylinder valve of the engine so as to reduce the compression pressure in the combustion chamber during starting of the engine, with results being that the starting force required to start the engine is reduced.

2. Description of Related Art

Automatic decompression mechanisms are typically employed in internal combustion (IC) engines to provide improved engine performance at a variety of engine speeds. Known mechanisms typically include a pivoting centrifugal component capable of varying an outside cam profile surface of a rotating cam gear when engine speeds are low, such as during the starting cycle of the engine. Such a centrifugal component is designed to selectively and temporarily open a cylinder valve of the engine during the starting cycle of the engine. If the cylinder valve is opened slightly and temporarily during the compression stroke of the starting cycle, it is helpful for decreasing the pressure in the cylinder and reducing the starting force required to start the engine. Once the engine is started and the engine is running at normal operating speeds, it is desirable to deactivate the decompression function so as to maximize engine power and reduce emissions.

Various decompression mechanisms of this type have been proposed in the art, for example as disclosed in U.S. Pat. Nos. 6,109,230; 6,343,582; and 5,943,992. One disadvantage of such prior art designs is that the assembled structures comprise a relatively large number parts, making the manufacture and assembly of the decompression mechanism relatively troublesome, and moreover making it difficult to reduce the cost and size of the mechanism.

It therefore would be desirable if a new automatic decompression mechanism were developed which employed a reduced number of parts and which was easily installed in combination with simple cam gear components. It further would be desirable if the new automatic decompression mechanism were to employ a simple cover member with an integrated biasing means adapted to retain the centrifugal member in the cam gear, and if the mechanism were to be relatively inexpensive to manufacture and assemble. Such a simple mechanism would also provide advantage by being more susceptible to automated assembly.

SUMMARY OF THE INVENTION

In accordance with the invention, an automatic decompression mechanism is provided for selectively actuating a cylinder valve of an engine so as to reduce the starting force required to start the engine. The mechanism includes a cam gear having a cam profile surface on one side of the cam gear for driving the cylinder valve mechanisms, and an annular recessed groove on the other side of the cam gear for housing a pivoting centrifugal member. The recessed groove of the cam gear includes a slot region with an opening at one end for communicating with the cam profile surface. The cam gear is driven by an associated drive gear (not shown), which in turn is driven by the crankshaft in a manner known in the art. The centrifugal member includes a projecting portion, a pivoting portion and a weight portion, and is pivotally housed within the recessed groove of the cam gear. A cover member comprising an integrally formed biasing means is employed to retain the centrifugal member within the recessed groove when the cover member is attached to the cam gear.

In operation, the biasing means is adapted to urge the centrifugal member into a decompression position when the cam gear is rotating at a lower speed, wherein under the action of a lower centrifugal force, the projecting portion of the centrifugal member is caused to project through the opening of the slot region and above the cam profile surface, thereby causing the projecting portion to temporarily actuate the cylinder valve mechanism, with results being that the starting force required to start the engine is reduced. Once the engine has been started and the cam gear is rotating at a higher operating speed, the centrifugal member pivots into a non-decompression position, wherein under the action of a higher centrifugal force, the projecting portion of the centrifugal member recedes back through the opening in the slot region and below the cam profile surface so as to prevent the projecting portion from actuating the valve mechanism during normal engine operation.

In an exemplary embodiment of the invention, the cam gear further includes a plurality of boss members which are configured in shape and size to be inserted into a set of mating apertures of the associated cover member. Such configuration allows the cover member to be fixedly attached to the cam gear, and allows the biasing means to pivotally retain the centrifugal member in the decompression position.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

The present invention pertains to an automatic decompression mechanism for selectively opening a cylinder valve of an engine so as to reduce the external starting force required to rotate the engine shaft during the starting cycle of the engine. In accordance with an exemplary embodiment of the present invention, the exhaust valve of an internal combustion (IC) engine is opened slightly and temporarily during the compression stroke of the starting cycle so as to decrease the pressure in the engine cylinder, thus reducing the starting force required to start the engine. Although the exemplary embodiment described herein provides a mechanism for selectively actuating the exhaust valve of an IC engine during the starting cycle, it is also possible to provide the decompression mechanism on the intake side so as to open the intake valve during the starting cycle. Moreover, although the present invention is described with reference to an IC engine, it is also possible to provide the decompression mechanism in other types of engine driven compression devices, for example air compressors, without departing from the broader scope of the invention.

Figure 1:
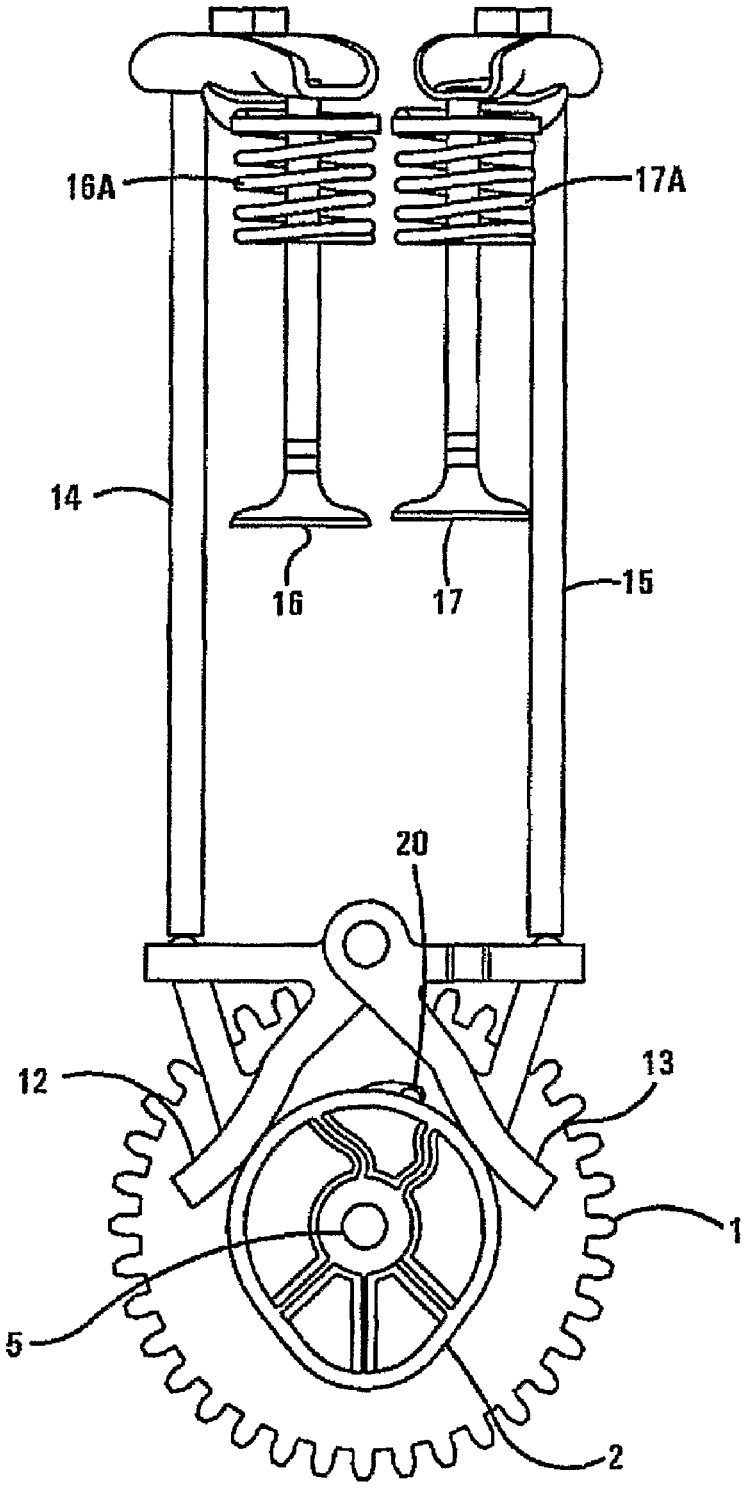
FIG. 1 is a front view of a decompression mechanism according to an exemplary embodiment of the invention.
Figure 2A:
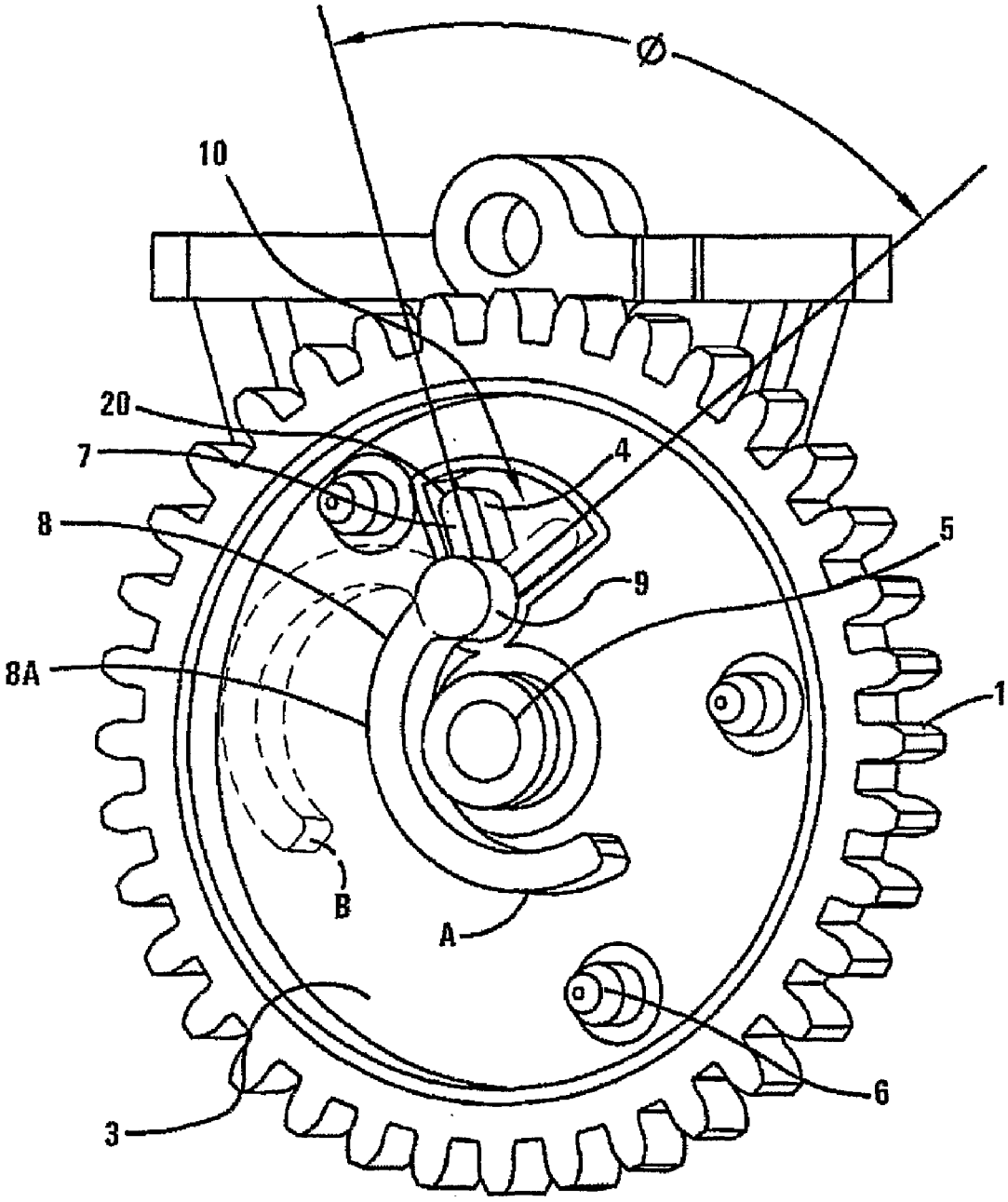
FIG. 2A is a perspective view of a cam gear of the decompression mechanism of FIG. 1, in which certain parts have been removed to reveal additional internal parts of the decompression mechanism.
Figure 2B:
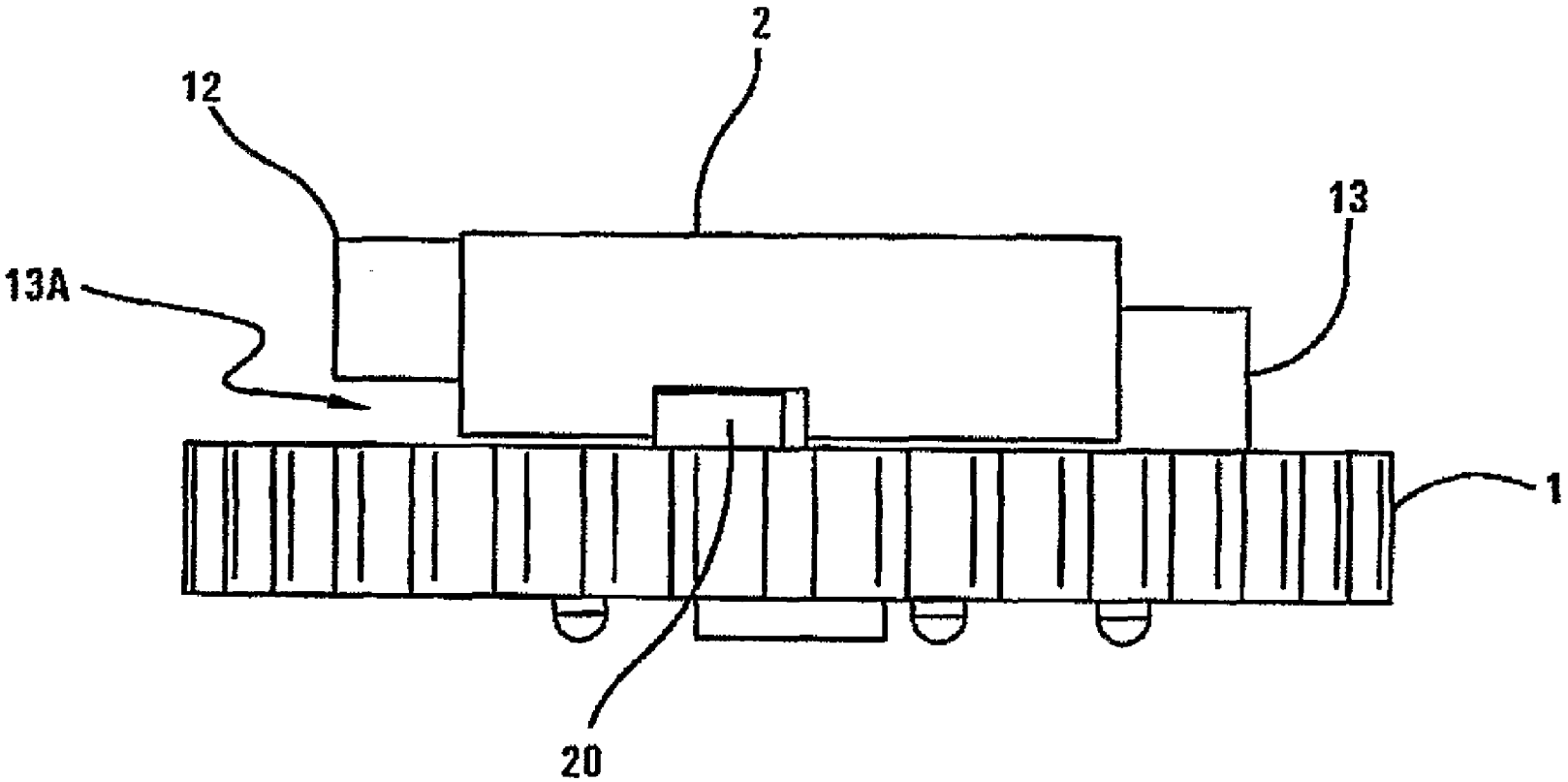
FIG. 2B is a side view of the cam gear, illustrating an offset in the orientation of the cam followers on the intake and exhaust sides of the decompression mechanism with respect to a bump portion on the cam profile surface of the cam gear.
Figure 3:
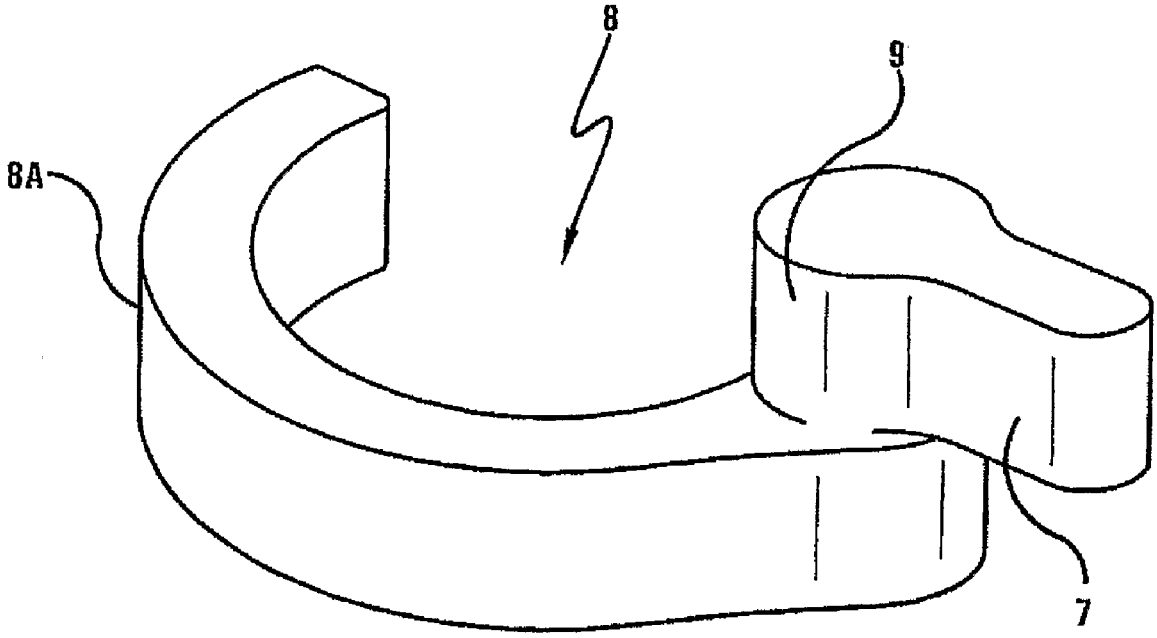
FIG. 3 is a perspective view of a centrifugal member according to an exemplary embodiment of the invention.

Referring to FIGS. 1, 2A and 2B, an exemplary decompression mechanism includes a cam gear 1 having a cam profile surface 2 on a first side of the cam gear 1, and a recessed groove 3 on the other side of the cam gear 1. The recessed groove 3 includes a cavity slot region 4, wherein one end of the slot region 4 includes an opening 10 communicating with the cam profile surface 2. A centrifugal member 8 comprising a projecting portion 7, a pivoting portion 9, and a weight portion 8A is housed within the recessed groove 3. The pivoting portion 9 of the centrifugal member 8 is received by the slot region 4 such that the centrifugal member is permitted to pivot between a decompression position A (shown with solid lines in FIG. 2A), and a non-decompression position B (shown with phantom lines in FIG. 2A). It is apparent that the angular distance Φ between the decompression position A and the non-decompression position B is less than 90 degrees, however, those skilled in the art will appreciate that such angular distance between the decompression position A and the non-decompression position B is not critical to the operation of the invention, and that the angle may be less than, equal to, or greater than 90 degrees, so long as such angular distance Φ is sufficient to cause the projecting portion 7 to protrude and recede with respect to the cam profile surface 2 in the decompression position A and non-decompression position B, respectively. An exemplary centrifugal member 8 configured for use with the present invention is shown in FIG. 3.

As shown in FIG. 2A, the side of the cam gear 1 with the recessed groove 3 further includes a plurality of boss members 6 which are configured in shape and size to be inserted into a mating set of apertures 19 of a cover member 18 as described in more detail below with reference to FIGS. 4, 5A and 5B.

With continued reference to FIG. 1, a first cam follower 12 and a second cam follower 13 are carried by the outer contour of the cam profile surface 2. Accordingly, when the cam gear 1 is rotating about its central hub axis, the cam profile surface 2 periodically lifts the first and second cam followers 12 and 13, which in turn drives the associated push rods 14 and 15 so as to periodically actuate the intake valve 16 and the exhaust valve 17 during each revolution of the cam gear 1. Also provided is a pair of valve springs 16A and 17A for biasing the intake and exhaust valves 16 and 17 in the closing direction during the respective closing cycle of the cam follower device.

Figure 4:
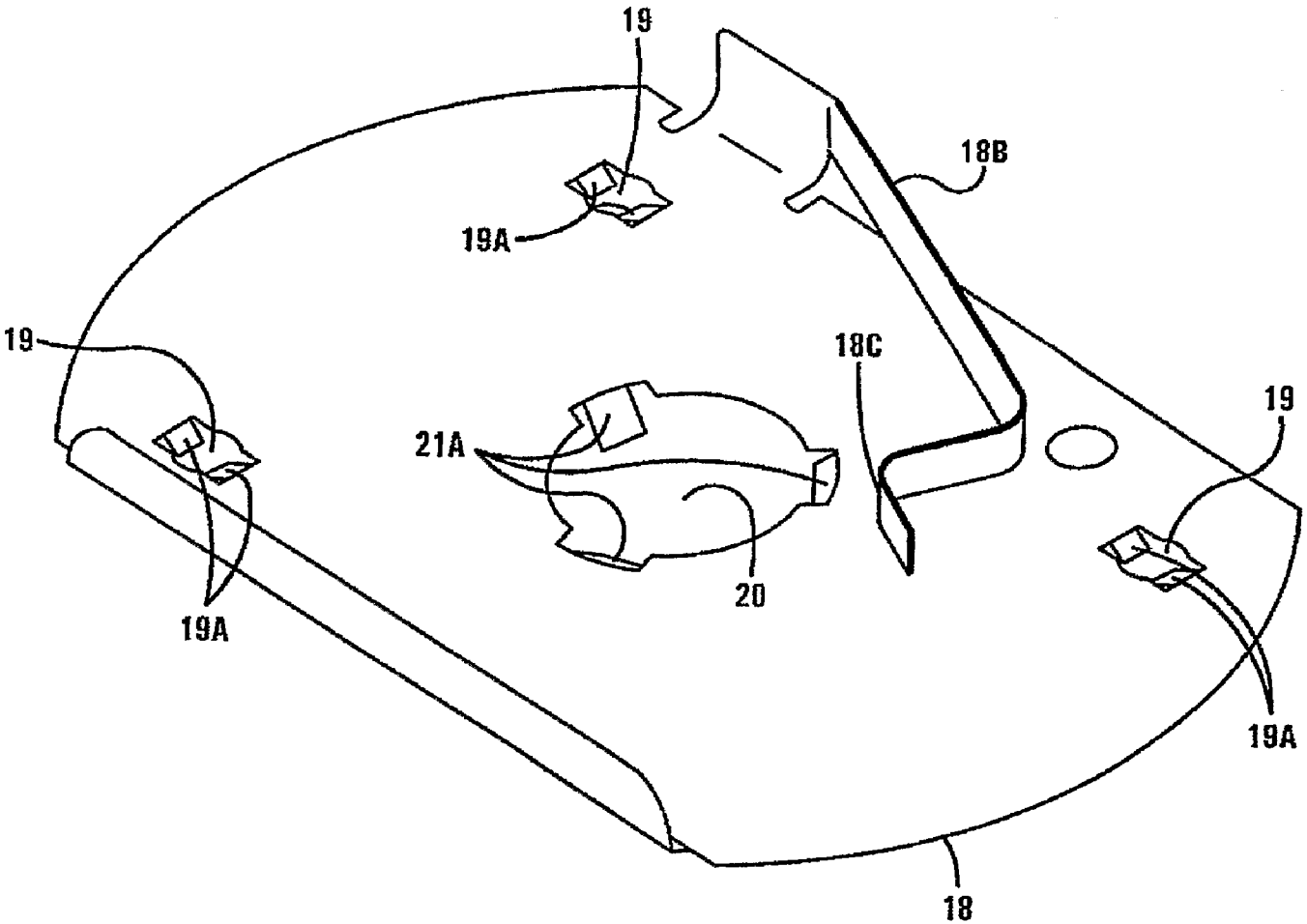
FIG. 4 is a perspective view of a cover member according to an exemplary embodiment of the invention, taken from a side of the cover member on which an integrated biasing means is located.
Figure 6:
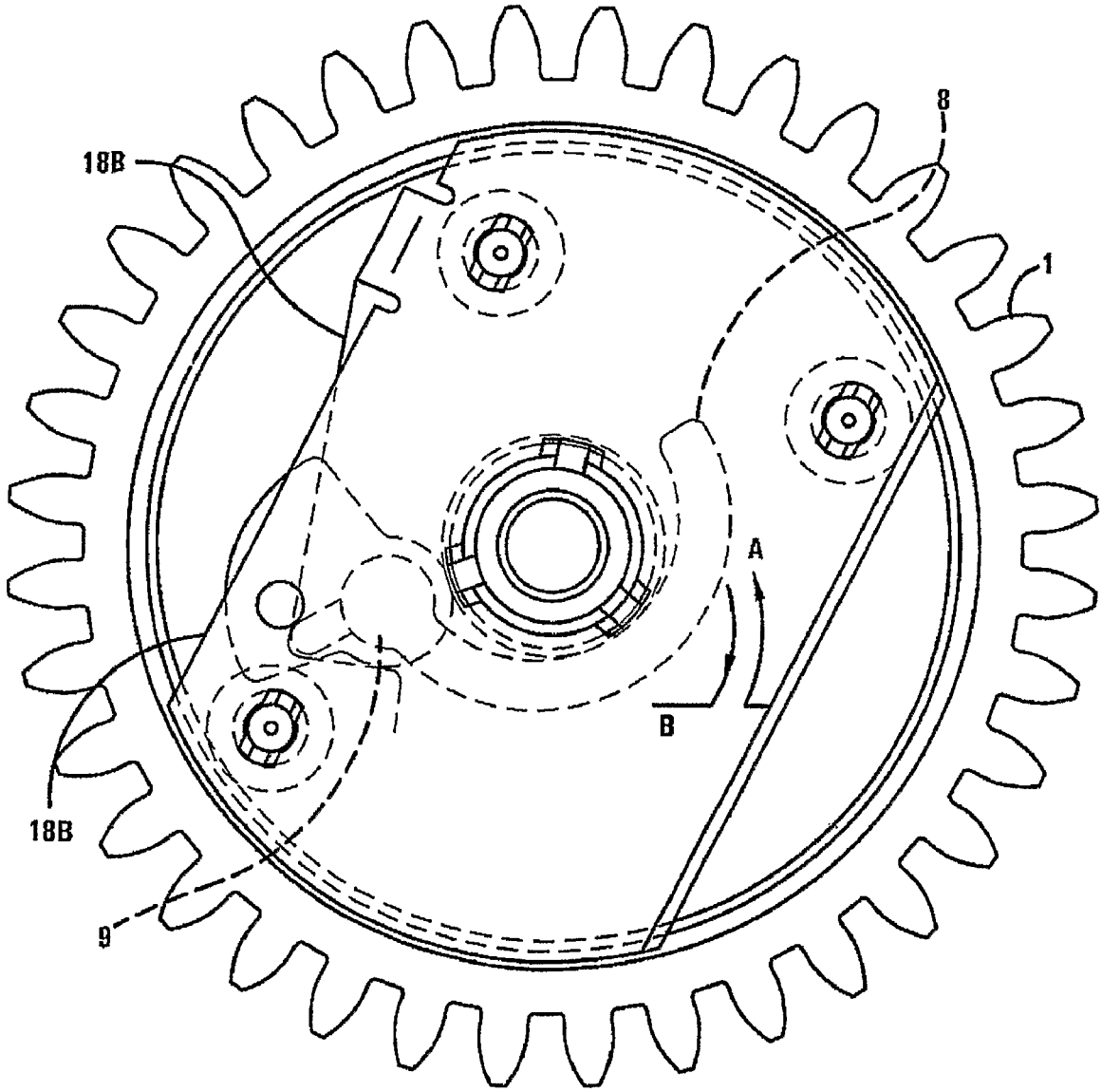
FIG. 6 is a front view showing the assembly of FIG. 5A, in which certain details have been removed to illustrate the configuration of the exemplary biasing means and centrifugal member.

Turning now to FIG. 4, there is shown an exemplary cover member 18 comprising an integrally formed biasing means 18B. By way of example, but not by way of limitation, the cover member 18 and biasing means 18B are integrally formed from a single piece of spring steel material. Desirably, the biasing means 18B is integrally formed from a peripheral portion of the cover member 18, and is configured in shape and size to function as a leaf-type spring so as to bias or urge the centrifugal member 8 toward the inner radius of the recessed groove 3 (i.e. toward a central hub 5 of the cam gear 1) when the cover member 18 is installed on the cam gear 1 as best shown in FIG. 6. Since the cover member 18 and biasing means 18B are integrally formed as a single component, a separate member, such as a retaining clip or pin, is not required to retain the centrifugal member 8 in the cam gear 1, thus further simplifying the structure. Such a simple integrated arrangement for the decompression mechanism contributes substantially to a reduction in manufacturing and assembly costs.

The cover member 18 further includes a plurality of apertures 19 spaced apart along the flat surface area of the cover member 18 for receiving the boss members 6 (FIG. 2A) of the cam gear 1. Each of the apertures 19 includes a set of locking tabs 19A which protrude from an inner edge of the apertures 19. The cover member 18 further has a center aperture 21 and an associated set of locking tabs 21A adapted to receive the center boss portion of the central hub 5. When the cover member 18 is installed on the cam gear 1, the boss members 6 and central hub 5 are inserted into the mating apertures 19, 21 of the cover member 18 such that the biting of the tabs 19A and 21A with respect to the boss members 6 and central hub 5 functions to retain the cover member 18 on the cam gear 1 as best shown in FIG. 5B.

Figure 5A:
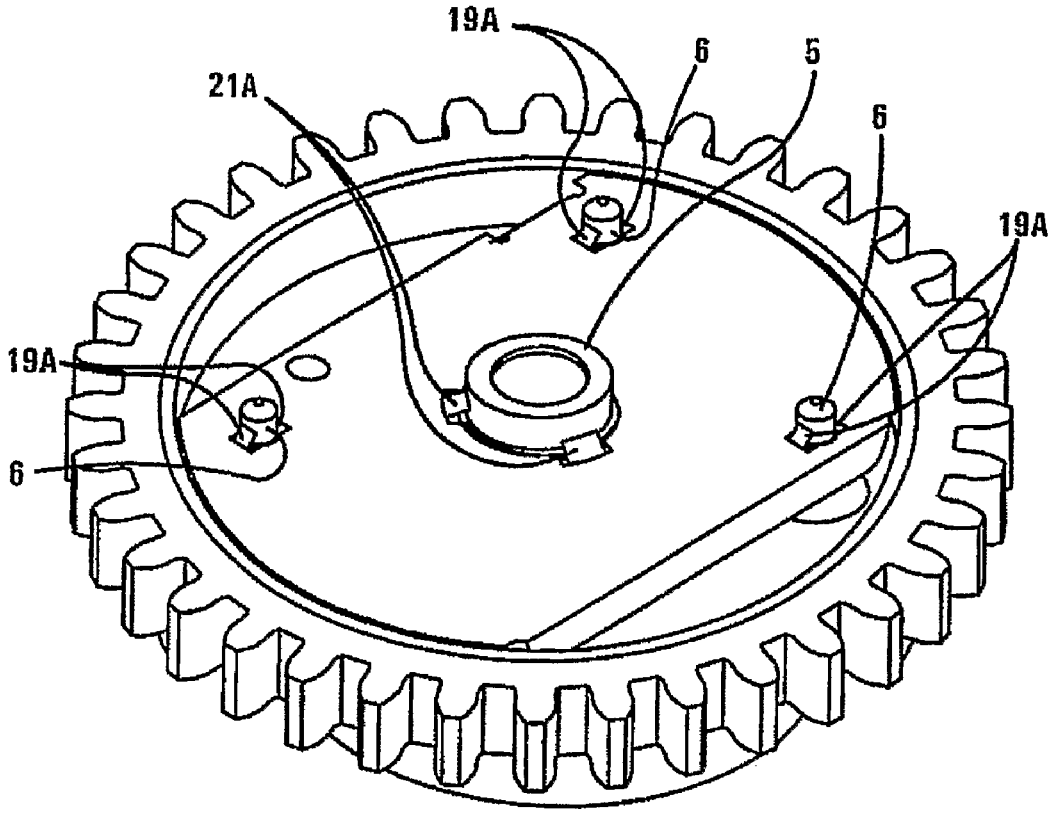
FIG. 5A is an exploded perspective view of the centrifugal member of FIG. 3 and the cover member of FIG. 4, wherein each component is ready for installation onto an exemplary cam gear.
Figure 5B:
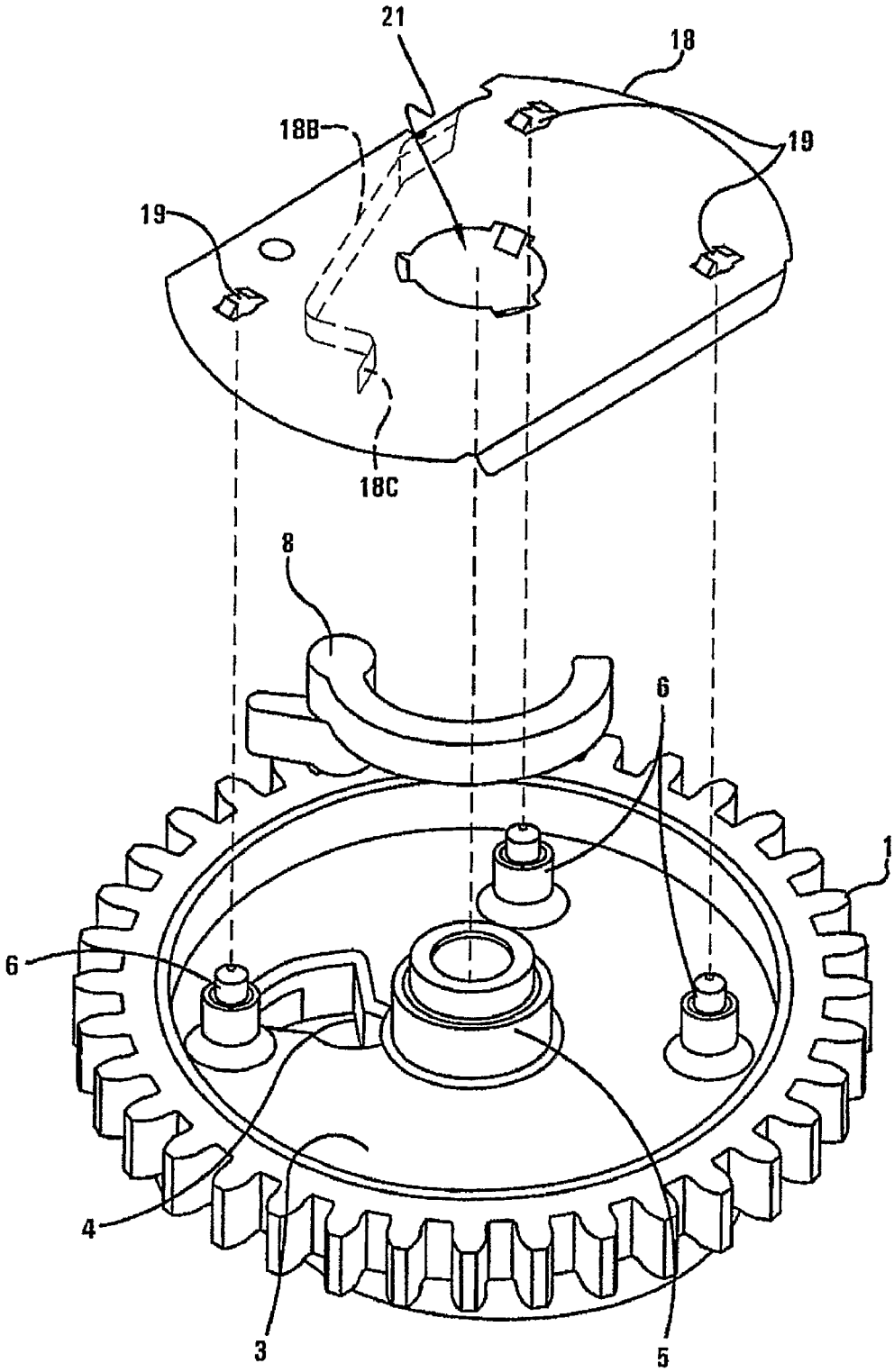
FIG. 5B is a perspective view showing the assembly of FIG. 5A.

Turning now to FIG. 5A, the pivoting portion 9 of the centrifugal member 8 is received by the slot region 4 of the recessed groove 3. The arcuate weight portion 8A of the centrifugal member 8 is positioned toward the inner radius of the recessed groove 3 and into the decompression position A such that the projecting portion 7 of the centrifugal member 8 projects through the opening 10 so as to create a bump 20 above the outside contour of the cam profile surface 2 as best seen in FIG. 2B. The cover member 18 is then attached to the cam gear 1 such that the integrated biasing means 18B is placed behind the weight portion 8A so as to urge the centrifugal member 8 toward the inner radius of the recessed groove 3 defined by the central hub 5 as best shown in FIG. 6. Due to the integrated configuration of the cover member 18 and biasing means 18B, it is a relatively simple task to place the tension end 18C of the biasing means 18B behind the weight portion 8A of the centrifugal member 8 so as to urge the centrifugal member 8 into the decompression position A as best shown in FIG. 6. Once the cover member 18 is installed on the cam gear 1 and the apertures 19 of the cover member 18 are engaged with the boss members 6 of the cam gear 1, the tension end 18C of the biasing means 18B is positioned proximate a back surface of the weight portion 8A, with results being that the tension end 18C urges the centrifugal member 8 toward the decompression position A when the cover member 18 is attached to the cam gear 1 as best shown in FIG. 6. Due to the integrated construction of the biasing means 18B and the simple arrangement of parts, the above process can be easily accomplished with manual or automated means.

Referring again to FIGS. 2A and 2B, when the centrifugal member 8 is positioned in the decompression position A, the projecting portion 7 of the centrifugal member 8 is caused to project through the opening 10 of the slot region 4 so as to create the bump 20 on the outside contour of the cam profile surface 2. Accordingly, under the action of a lower centrifugal force when the cam gear 1 is rotating at a lower speed during the starting cycle of the engine, the projecting portion 7 contacts the cam follower 13 which lifts the second push rod 15, which in turn functions to temporarily actuate the exhaust valve 17, thereby releasing pressure from the compression chamber during the compression stroke and reducing the starting force required to start the engine.

Once the engine has been started and the cam gear 1 is rotating at a higher operating speed, the centrifugal member 8 pivots away from the inner radius of the recessed groove 3 and toward the outer radius of the recessed groove, i.e., from the decompression position A to the non-decompression position B as shown in phantom in FIG. 2A. Accordingly, the weight portion 8A swings toward the outer radius of the recessed groove 3, wherein under the action of a higher centrifugal force, the projecting portion 7 recedes back through the opening 10, below the cam profile surface 2 and into the non-decompression position B so as to eliminate the bump 20 on the cam profile surface and thereby disable the decompression function. The relatively higher centrifugal force from rotation of the cam gear 1 during normal engine operation is strong enough to overcome the opposing biasing force of the biasing means 18B, thereby allowing the weight portion 8A of the centrifugal member 8 to pivot out against the biasing force of the biasing means 18B and into the non-decompression position B. During normal operating speeds, when the centrifugal member 8 is located in the non-decompression position B, the projecting portion 7 of the centrifugal member 8 recedes below the cam profile surface 2, thereby eliminating the bump 20 and disabling the decompression function.

As discussed above, in order to reduce the starting force required to start the engine, the decompression function is enabled during the starting cycle of the engine. Once the engine is started, the decompression function is disabled so as to improve operating power and reduce emissions. Those skilled in the art will appreciate that the present decompression device also reduces the possibility of engine "kickback". Moreover, the decompression device of the present invention provides further advantage in that it requires a relatively low number of parts, and significantly reduces manufacturing and assembly costs and is more susceptible to automated assembly.

In the exemplary embodiment of the present invention, it is to be understood that only the exhaust valve 17 is actuated by the decompression mechanism during the decompression function. As best shown in FIG. 2B, the cam follower 12 on the intake side of the device is offset with respect to the bump 20 on the cam profile surface 2, thereby creating a clearance gap 13A between the cam gear 1 and the cam follower 12, with results being that the bump 20 does not actuate the cam follower 12 and associated intake valve 16 during the decompression function. However, due to the absence of any such gap on the exhaust side of the cam gear 1 and associated cam follower 13, the bump 20 will only actuate the cam follower 13 and associated exhaust valve 17 during the decompression function. Of course, it is also possible to reverse the offset, i.e. provide the offset on the intake side so that the bump will only actuate the cam follower 12 and associated intake valve 16 during the starting cycle.

While the disclosure has been illustrated and described with respect to exemplary embodiments, it is not intended to be limited to the details shown, since various modifications and substitutions can be made without departing from the spirit of the present disclosure. As such, further modifications and equivalents of the disclosure herein disclosed may occur to persons skilled in the art using no more than routine experimentation, and all such modifications and equivalents are believed to be within the scope of the disclosure as defined by the following claims.

What is claimed is:

1. An automatic decompression mechanism for selectively actuating a valve mechanism of an engine to reduce the compression pressure in a combustion chamber while starting the engine, said decompression mechanism comprising:

a cam gear having a first side and a second side, said first side defining a cam profile surface for driving said valve mechanism, said second side having a slot region disposed therein, said slot region having an opening communicating with said cam profile surface;

a centrifugal member disposed on the second side of the cam gear, said centrifugal member having a projecting portion, a pivot portion and a weight portion, said pivot and projecting portion being pivotally received within said slot region;

a cover member mounted to said second side of said cam gear;

a biasing means integrally formed from a portion of said cover member, said biasing means adapted to urge said centrifugal member into a decompression position when said cam gear is rotating at a lower speed, wherein under the action of a lower centrifugal force, said weight portion is positioned proximate an inner portion of said cam gear causing said projecting portion to project through said opening and above said cam profile surface, thereby causing said projecting portion to temporarily actuate said valve mechanism; and wherein said centrifugal member pivots to a non-decompression position when said cam gear is rotating at a higher speed, wherein under the action of a higher centrifugal force said weight portion is positioned proximate an outer portion of said cam gear causing said projecting portion to recede below said cam profile surface, thereby preventing said projecting portion from actuating said valve mechanism.

2. The decompression mechanism as recited in claim 1, wherein said slot region is disposed in a recessed groove on said second side of the cam gear, and said centrifugal member is disposed at least partially in said recessed groove.

3. The decompression mechanism as recited in claim 2, wherein said biasing means urges said centrifugal member into a decompression position when said cam gear is rotating at a lower speed such that said weight portion is positioned proximate an inner radius or said recessed grove so that said projecting portion projects through said opening and above said cam profile surface, and wherein said centrifugal member pivots to a non-decompression position when said cam gear is rotating at a higher speed such that said weight portion is positioned proximate an outer radius of said recessed groove so that said projecting portion recedes below said cam profile surface.

4. The decompression mechanism as recited in claim 3, wherein said cover member is formed of spring steel, and said integrated biasing means is formed in the shape of a leaf-type spring.

5. The decompression mechanism as recited in claim 4, wherein said integrated biasing means is formed from a peripheral portion of said cover member.

6. The decompression mechanism as recited in claim 1, wherein said second side of said cam gear further includes at least one boss member, wherein said cover member further includes at least one aperture, said aperture being adapted to receive said at least one boss member, and wherein said aperture includes at least one tab portion for creating an interference fit between said at least one aperture and said at least one boss member so as to retain said cover member on said second side of said cam gear.

7. The decompression mechanism as recited in claim 1, wherein said valve mechanism is an exhaust valve mechanism and said engine is an internal combustion engine.

8. The decompression mechanism as recited in claim 1, wherein said biasing means engages a back portion of said weight portion.

9. The decompression mechanism as recited in claim 1, wherein an angular distance between said decompression and non-decompression positions is less than about 90 degrees.

10. A method of assembling an automatic decompression mechanism for selectively actuating a valve mechanism of an engine, said method comprising the steps of:

(a) providing a cam gear having a first side and a second side, said first side defining a cam profile surface for driving said valve mechanism, said second side comprising a recessed groove with a slot region disposed therein, said slot region having an opening communicating with said cam profile surface;

(b) providing a centrifugal member having a projecting portion, a pivot portion and a weight portion;

(c) providing a cover member with an integrally formed biasing means;

(d) inserting said pivot portion and said projecting portion into said slot region so that said weight portion of said centrifugal member is located proximate an inner radius of said recessed groove;

(e) mounting said cover member to said second side of said cam gear;

(f) positioning said biasing means so that a tension end of said biasing means is proximate a back surface of said weight portion, thereby urging said centrifugal member into a decompression position wherein said projecting portion projects through said opening and above said cam profile surface;

(g) rotating said cam gear at a lower speed, wherein under the action of a lower centrifugal force, said biasing means maintains said centrifugal member in said decompression position, wherein said projecting portion projects through said opening and above said cam profile surface, thereby causing said projecting portion to temporarily actuate said valve mechanism; and (h) rotating said cam gear at a higher speed, wherein under the action of a higher centrifugal force, said biasing means allows said centrifugal member to pivot into a non-decompression position, wherein said projecting portion recedes below said cam profile surface, thereby preventing said projecting portion from actuating said valve mechanism.

11. The method as recited in claim 10, wherein said second side further includes at least one boss member, and wherein said cover member includes at least one aperture for receiving said at least one boss member, said aperture comprising at least one tab portion for creating an interference fit between said at least one aperture and said at least one boss member, and wherein said mounting step (e) further includes the step of inserting said at least one boss member through said at least one aperture so that said at least one tab portion retains said cover member on said second side of said cam gear.

12. The method as recited in claim 11, wherein said cover member is formed of spring steel and said integrated biasing means is a leaf-type spring.

13. The method as recited in claim 12, wherein said integrated biasing means is formed from a peripheral portion of said cover member.

14. The method as recited in claim 13, wherein said valve mechanism is an exhaust valve mechanism and said engine is an internal combustion engine.

15. The method as recited in claim 14, wherein said biasing means engages a back portion of said weight portion.

16. The method as recited in claim 15, wherein an angular distance between said decompression and non-decompression positions is less than about 90 degrees.

* * * * *